US007533772B2

(12) United States Patent
Yoshifusa et al.

(10) Patent No.: US 7,533,772 B2
(45) Date of Patent: May 19, 2009

(54) STRUCTURE OF AIR-PACKING DEVICE

(75) Inventors: Kark K. Yoshifusa, Lake Forest, CA (US); Wei-Wen Peng, Lake Forest, CA (US)

(73) Assignee: Air- Paq, Inc., Lake Forest, CA (US)

( * ) Notice: Subject to any disclaimer, the term of this patent is extended or adjusted under 35 U.S.C. 154(b) by 102 days.

(21) Appl. No.: 11/255,385

(22) Filed: Oct. 20, 2005

(65) Prior Publication Data

US 2007/0090013 A1 Apr. 26, 2007

(51) Int. Cl.
*B65D 81/02* (2006.01)

(52) U.S. Cl. ..... 206/522; 206/521; 206/592; 383/3

(58) Field of Classification Search ..... 206/521, 206/522, 591, 592, 593, 594; 383/3, 38, 383/39, 40
See application file for complete search history.

(56) References Cited

U.S. PATENT DOCUMENTS 4,569,082 A * 2/1986 Ainsworth et al. ..... 383/3
4,793,123 A * 12/1988 Pharo ..... 53/449
5,469,966 A 11/1995 Boyer
5,826,723 A 10/1998 Jaszai
6,629,777 B2 10/2003 Tanaka et al.
7,165,677 B2 * 1/2007 Tanaka et al. ..... 206/522
7,249,612 B2 * 7/2007 Koyanagi ..... 137/846
2002/0081041 A1 * 6/2002 Malone et al. ..... 383/3
2004/0265523 A1 * 12/2004 Koyanagi et al. ..... 428/35.7
2007/0051655 A1 * 3/2007 Yoshifusa ..... 206/522

* cited by examiner

*Primary Examiner*—David T Fidei
(74) *Attorney, Agent, or Firm*—Finnegan, Henderson, Farabow, Garrett & Dunner L.L.P.

(57) ABSTRACT

An air-packing device has an improved shock absorbing capability to protect a product in a container box. The air-packing device is comprised of first and second thermoplastic films where predetermined portions are bonded thereby creating a plurality of air containers, a plurality of heat-seal lands each sealing the first and second thermoplastic films in a small area of the air container thereby creating a plurality of series connected air cells for each air container, a plurality of check valves for corresponding air containers for allowing the compressed air to flow in a forward direction, and at least one pocket formed of a sheet of thermoplastic film bonded to either the first thermoplastic film or the second thermoplatic film at boundaries between two adjacent air containers. The air-packing device is folded after the product is inserted in the pocket and installed in a container box.

15 Claims, 16 Drawing Sheets

STRUCTURE OF AIR-PACKING DEVICE

FIELD OF THE INVENTION

This invention relates to a structure of an air-packing device for use as packing material, and more particularly, to a structure of an air-packing device and check valves incorporated therein for achieving an improved shock absorbing capability to protect a product from a shock or impact by packing the product within a space having a shape unique to the product.

BACKGROUND OF THE INVENTION

In product distribution channels such as product shipping, a Styrofoam packing material has been used for a long time for packing commodity and industrial products. Although the styrofoam package material has a merit such as a good thermal insulation performance and a light weight, it has also various disadvantages: recycling the styrofoam is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter also referred to as an "air-packing device"). The air-packing device has excellent characteristics to solve the problems involved in the styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of an air-packing device in the conventional technology. The air-packing device 20 includes a plurality of air containers 22 and check valves 24, a guide passage 21 and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated because of the corresponding check valves.

FIG. 2 is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as, wine bottles, DVD drivers, music instruments, glass or ceramic wares, antiques, etc. that need special attention so as not to receive a shock, vibration or other mechanical impact. Thus, it is desired that the air-packing device protects the product to minimize the shock and impact.

SUMMARY OF THE INVENTION

It is, therefore, an object of the present invention to provide a structure of an air-packing device for packing a product that can minimize a shock or vibration and protect the product.

It is another object of the present invention to provide a structure of an air-packing device for packing a product by a packing space created by the air-packing device unique to a particular product.

It is a further object of the present invention to provide a structure of an air-packing device for packing a toner cartridge by a packing space created by the air-packing device unique to the toner cartridge.

In one aspect of the present invention, an air-packing device inflatable by compressed air for protecting a product therein when stored in a container box, comprising: first and second thermoplastic films superposed with each other where predetermined portions of the first and second thermoplastic films are bonded, thereby creating a plurality of air containers; a plurality of heat-seal lands each sealing the first and second thermoplastic films in a small area of the air container in a manner to allow air flow between the air cells, thereby creating a plurality of series connected air cells for each air container; a plurality of check valves for corresponding air containers established between the first and second thermoplastic films for allowing the compressed air to flow in a forward direction; an air input commonly connected to the plurality of check valves to supply the compressed air to all of the air cells through the check valves; and at least one pocket formed of a sheet of thermoplastic film bonded to either the first thermoplastic film or the second thermoplatic film at boundaries between two adjacent air containers. The air-packing device is filled with the compressed air and is folded at the heat-seal lands, thereby packing the product therein.

The product is installed in the pocket and the air cells of the air-packing device are inwardly folded when packing the product therein. The air-packing device which packs the product therein is installed in a container box.

Each end of the sheet forming each of the pockets is bonded to an area where the first and second thermoplastic films are bonded to one another where the sheet has a sufficient length so that a sufficient space is created over the air cells for receiving the product therein.

Each of the heat-seal lands which heat-seal the first and second thermoplastic films is formed at about a center of the air container to define the air cells, the heat-seal lands are folding points when the air-packing device is inflated by the compressed air. Each of the heat-seal lands creates two air flow passages at both sides thereof in the air container thereby allowing the compressed air to flow to the series connected air cells through the two air passages.

The air-packing device further includes a pocket portion created by folding the air-packing device in such a way that a longitudinal end comes to an intermediate portion of the air packing device and heat-sealing the side edges thereof that are overlapped with one another. The pocket portion is created before inflating the air-packing device by folding the air-packing device and heat-sealing the side edges thereof that are overlapped with one another.

The check valve includes sealed portions which are fixed to one of thermoplastic films configuring the air-packing device, where the sealed portions include an inlet portion which introduces the air into the check valve; a pair of narrow down portions creating a narrow down passage connected to the inlet portion; an extended portion which diverts the air flows coming through the narrow down passage; and a plurality of outlet portions which introduce the air from the extended portion to the air container.

Alternatively, the check valve is comprised of a check valve film on which peeling agents of predetermined pattern are printed, the check valve film being attached to one of first and second thermoplastic films configuring the air-packing device; an air input established by one of the peeling agents on the air-packing device for receiving an air from an air source; an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells; wherein heat-sealing between the first and second thermoplastic films for separating two adjacent air containers is prevented in a range where the peeling agent is printed.

According to the present invention, the air-packing device can minimize the shocks or vibrations to the product when the product is dropped or collided. The air-packing device is comprised of multiple rows of air containers each having a plurality of air cells connected in series. One or more pockets are formed by using additional thermoplastic films to receive a product and its accessories therein. After being inflated by the compressed air, the air-packing device is folded, thereby creating a unique structure and stored in container box.

BRIEF DESCRIPTION OF THE DRAWINGS

FIG. 11A shows a cross sectional plan view of the check valve, FIG. 11B shows a cross sectional side view thereof, and FIG. 11C shows a cross sectional side view for explaining the operation of the check valve.

FIG. 12A is a plan view showing a structure of a check valve on an air-packing device, FIG. 12B is a plan view showing the check valve including flows of air when a compressed air is supplied thereto, FIG. 12C is a plan view showing the portions for bonding the check valve sheet to a thermoplastic film of the air-packing device, and FIG. 12D is a plan view showing the portions for bonding the check valve sheet and the two plastic films of the air-packing device.

FIG. 15A shows air flows in the air cells of the air-packing device when being inflated, and FIG. 15B shows a situation where the air-packing device is fully inflated and the check valve is closed.

DETAILED DESCRIPTION OF THE INVENTION

The air-packing device of the present invention will be described in more detail with reference to the accompanying drawings. It should be noted that although the present invention is described for the case of using an air for inflating the air-packing device for an illustration purpose, other fluids such as other types of gas or liquid can also be used. The air-packing device is typically used in a container box to pack a product during the distribution channel of the product.

The air-packing device of the present invention is especially useful for packing products which are sensitive to shock or vibration such as hard disk drives, personal computers, DVD drivers, bottles, glassware, ceramic ware, music instruments, paintings, antiques, etc. Especially, the air-packing device of the present invention is most advantageously applied for packing a small product with several accessories such as a cellular phone, etc. The air-packing device reliably wraps the product and its accessaries in corresponding pockests before or after being inflated by a compressed. The air-packing device is folded to create a unique shape when the air-packing device wrapping the product is stored in a container box. Thus, the air-packing device absorbs the shocks and impacts that would be applied to the product when, for example, the product is inadvertently dropped on the floor or collided with other objects.

The air-packing device of the present invention includes a plurality of air containers each having a plurality of serially connected air cells. The air container is air-tightly separated from the other air containers while the air cells in the same air container are connected by the air passages such that the air can flow among the air cells through the air passages. Each air cell in the air container has a sausage like shape when the air is filled in the air containers. The air-packing device further has one or more pockets each being configured by a sheet of plastic film. The air-packing device stores the intended product and its accessories in the corresponding pockets. Then, the air-packing device is folded to a shape that fits to a container box.

Figure 1:
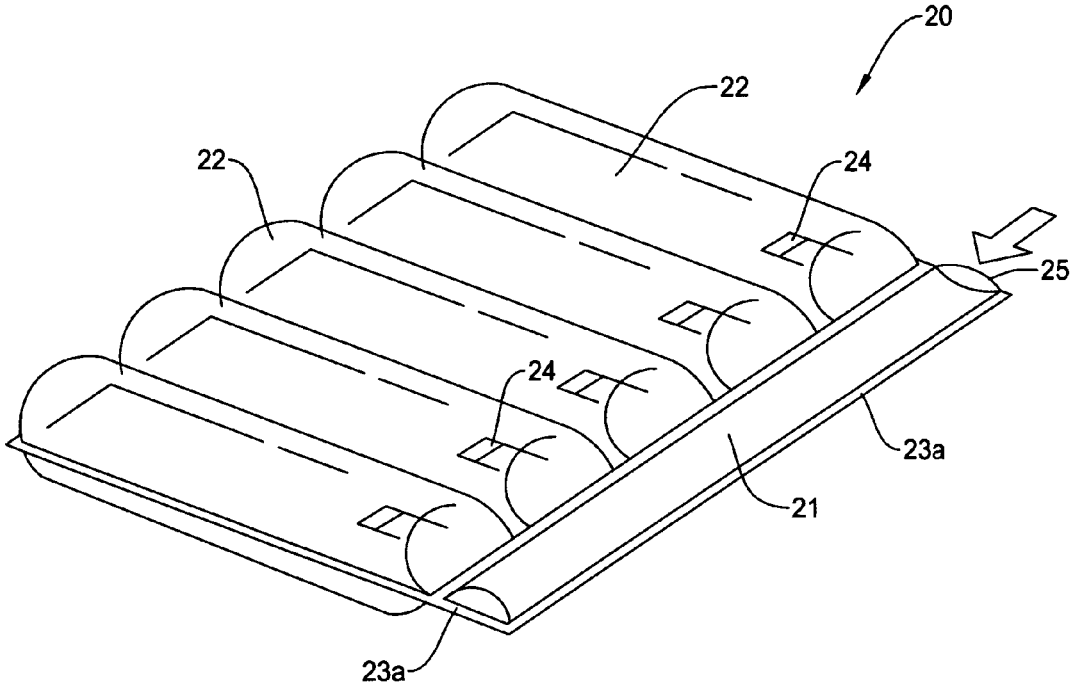
FIG. 1 is a schematic perspective view showing an example of basic structure of an air-packing device in the conventional technology.
Figure 2:
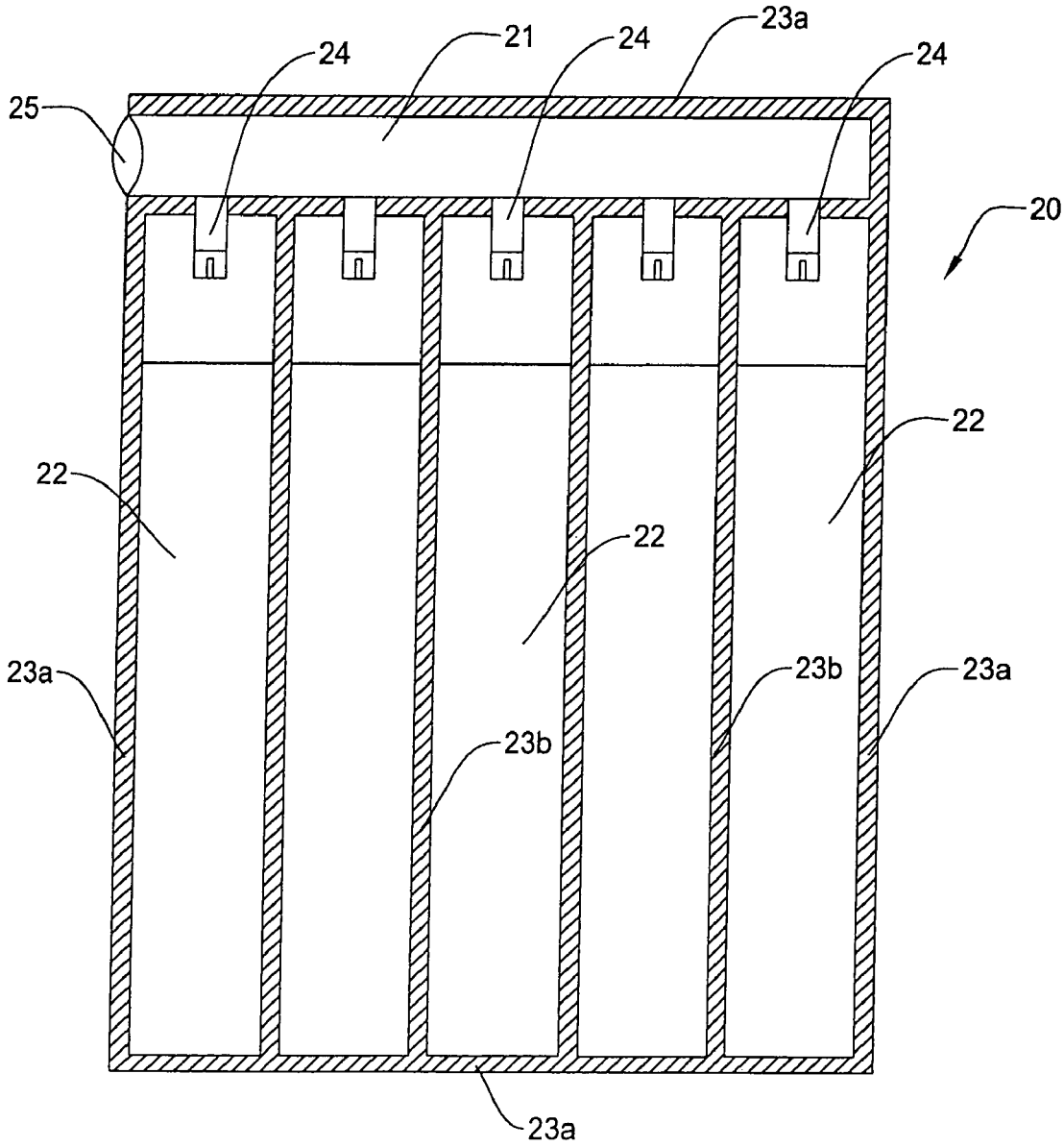
FIG. 2 is a plan view of the air-packing device 20 of FIG. 1 when it is not inflated for showing bonding areas for closing two thermoplastic films.
Figure 3:
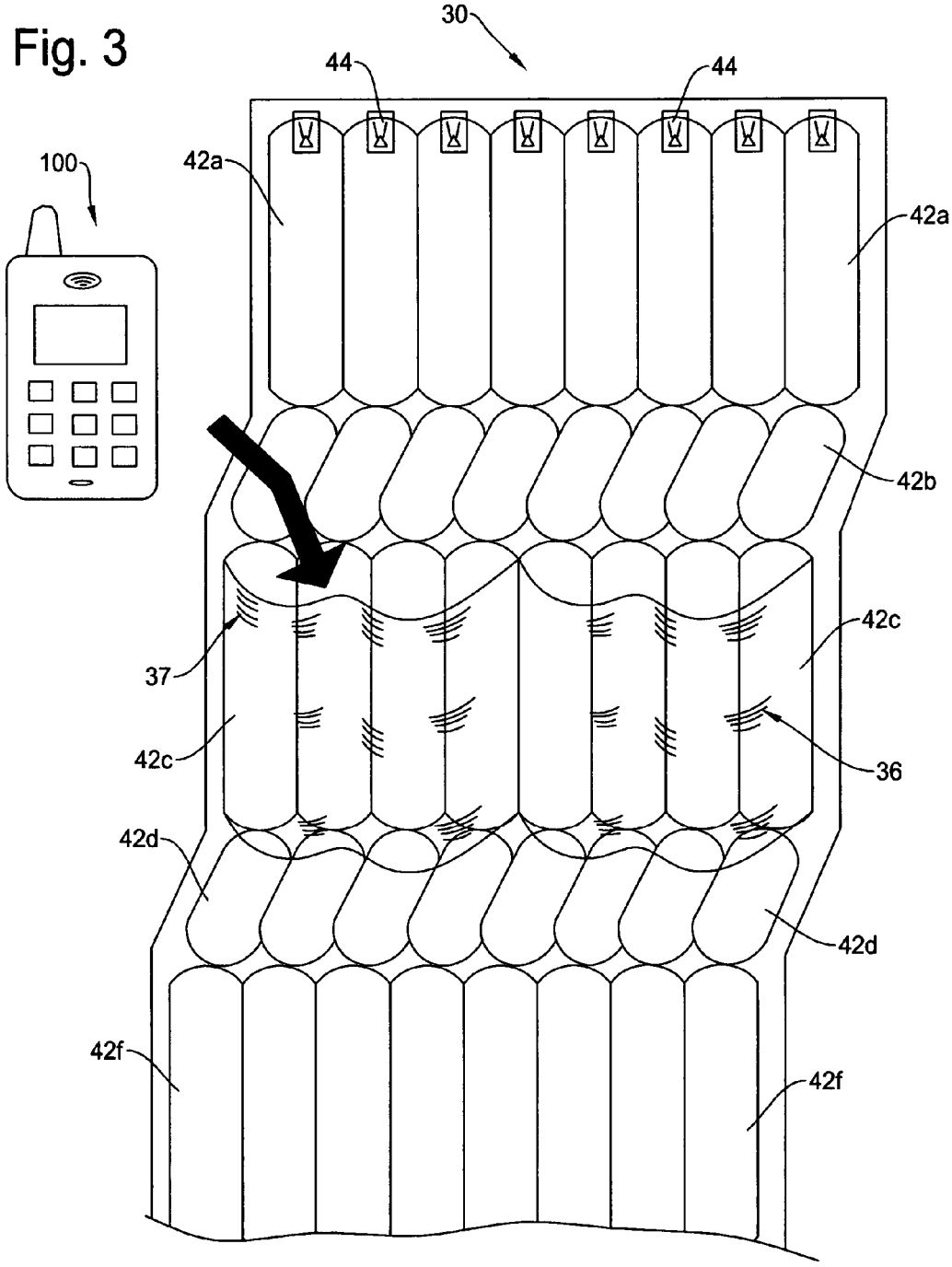
FIG. 3 is a perspective view showing an example of partial structure of the air-packing having a pocket in accordance with the present invention.

FIG. 3 is a perspective view showing an example of partial structure of the air-packing device 30 in the present invention. The air-packing device 30 is configured by a plurality of air containers each having a check valve 44 and a plurality of air cells 42*a*-42*g* in series. The air-packing device 30 of the present invention is further configured by one or more pockets 136 and 137 each of which is formed of a sheet of film. Preferably, such a sheet of film is a thermoplastic film each end of which is heat-sealed to a boundary area between two adjacent air containers. The sheet has a sufficient length so that a sufficient space of the pocket is created over the air cells for receiving the product therein.

A product 100, which is for example a cellular phone, is shown in FIG. 3 and will be placed in the pockets 136, 137 and packed by the air-packing device 30 for protection from shocks and vibrations. Typically, such a product has accessaries, for example, a battery charger, an operation manual, etc. When the product 100 and its accessaries are inserted in the corresponding pockets 136 and 137, the air-packing device 30 is folded to create a unique shape which fits in a container box. The container box is made of hard paper, corrugated fiber board, etc., commonly used in the industry. Thus, the product 100 and its accessaries are securely held in the corresponding pockets 136 and 137 and further tightly packed by the air-packing device 30 when installed in the container box.

Figure 4:
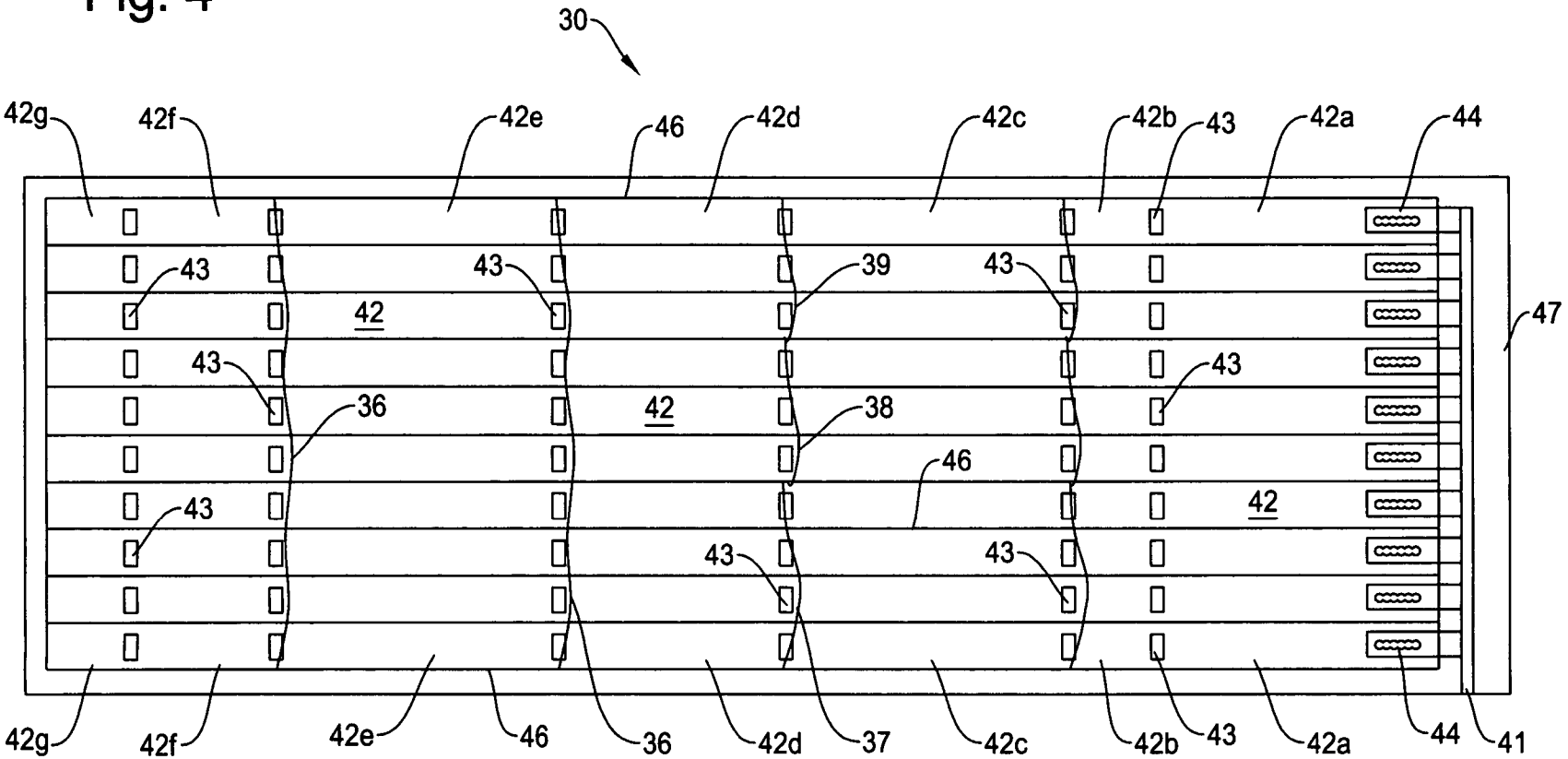
FIG. 4 is a plan view showing an example of sheet like construction of the first embodiment of the air-packing device of the present invention before being inflated by the compressed air.

The first embodiment of the air-packing device of the present invention is described with reference to FIGS. 4 to 8. A plan view of FIG. 4 shows an example of sheet like construction of the air-packing device 30 in the first embodiment of the present invention before being inflated by the air. The air packing device 30 is made of two thermoplastic films which are bonded (heat-sealed) together to create the plurality of air containers 42. Such bonded areas are denoted by reference numerals 46 and 47 which air tightly separate the air containers 42 from one another. In the air-packing device 30, each air container 42 has a plurality of serially connected air cells 42*a*-42*g*.

More specifically, the air cells 42*a*-42*g* connected in series are created by bonding (heat-sealing) the two thermoplastic films of the air container 42 at each small heat-seal land (separator) 43. The heat-seal lands 43 are small area on the air container 42 and do not completely separate the adjacent air cells 42*a*-42*g*. Thus, two small air passages (upper side and lower side of the heat-seal land 43) are created for allowing the air to flow therethrough toward the next air cell. The heat-seal lands 43 are provided to create the air cells 42*a*-42*g* as well as to define the location for folding the air-packing device 30. In the present invention, additional sheets of thermoplastic films are heat-sealed to the air-packing device 30 to create pockets 36-39. Typically, each of the pockets 36-39 is established by bonding the both ends of the thermoplastic sheet to the bonded areas 46 between the adjacent air containers 42.

Figure 5:
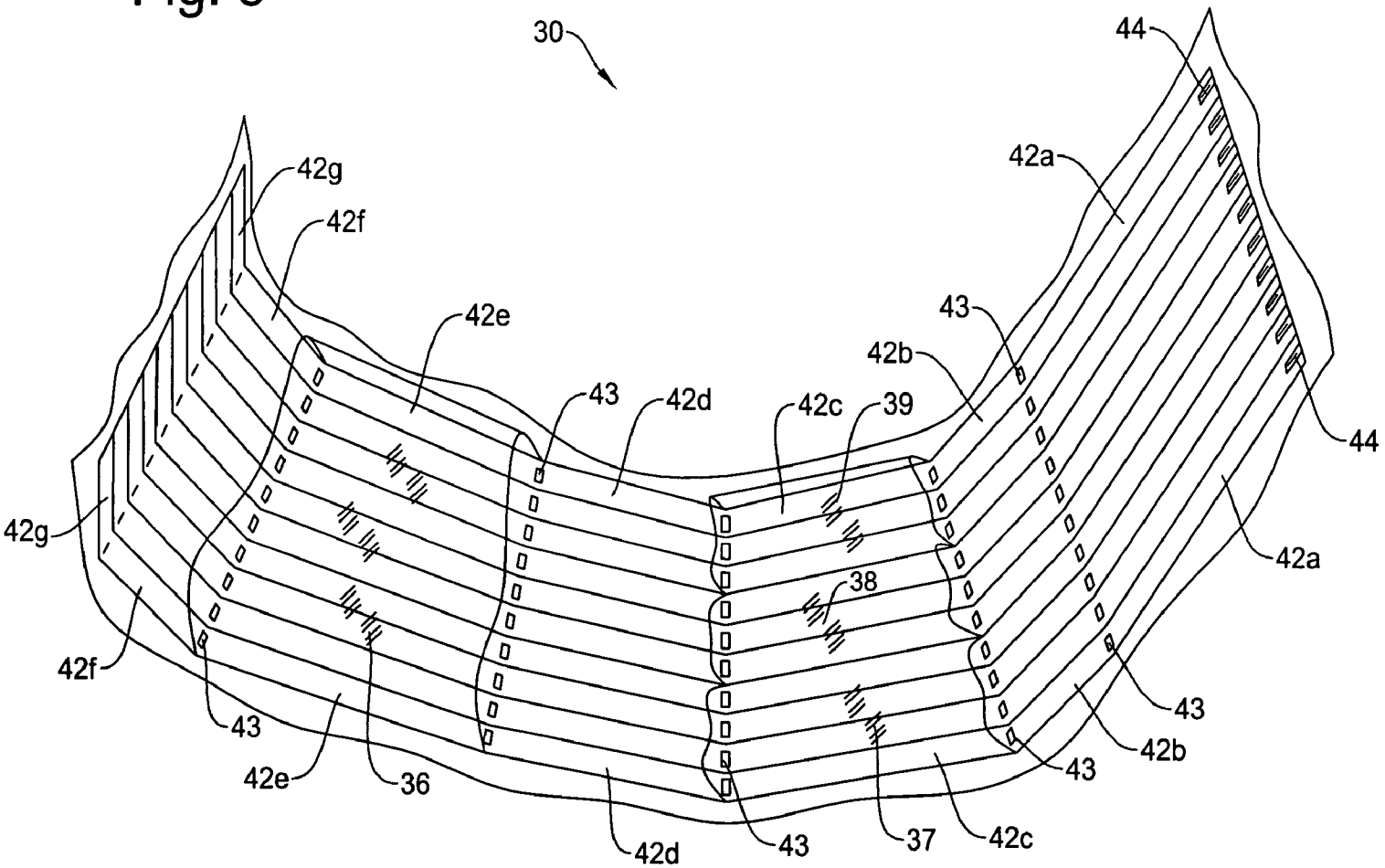
FIG. 5 is a perspective view showing an example of sheet like structure of the air-packing device of the present invention having a plurality of pockets.

Typically, each air container 42 is provided with a check valve 44 at one end so that the compressed air is maintained in the air container because the check valve 44 prohibits a reverse flow of the air. In the example of FIG. 5, the check valves 44 are provided at about the right end of the air-packing device 30 and are commonly connected to an air input 41. When the compressed air is supplied through the air input 41 from an air compresseor (not shown), the air flows through the check valves 44 and inflates all of the air cells 42*a*-42*g*.

FIG. 5 is a perspective view of the air-packing device 30 of the present invention showing a situation where the air-packing device 30 is slightly folded or bent to more clearly illustrate the structure of the pockets 36-39 thereon. As noted above, the air-packing device of the present invention is most suited for packing a small product with several accessaries, such as a cellular phone, although the application of the present invention is not limited to such a particular product. As noted above, since the thermoplastic films are bonded together at each heat-seal land 43, when the compressed air is filled in the air-container 30, each heat-land functions as a folding point.

Figure 6A:
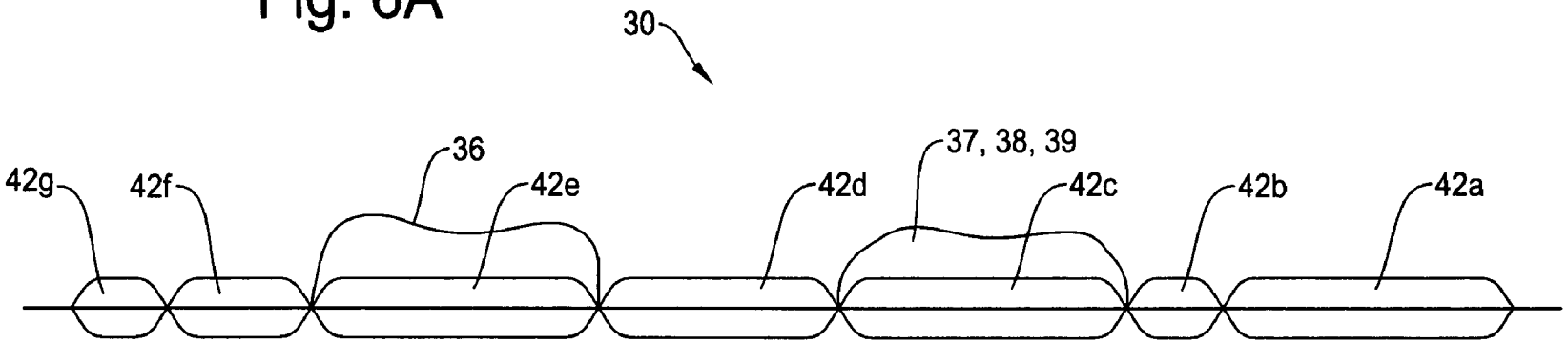
FIGS. 6A and 6B are front views of the air-packing device of the present invention having a plurality of pockets and inflated by the compressed air, where the air-packing device is laid flat in FIG. 6A and the air-packing device is slightly folded in FIG. 6B.
Figure 6B:
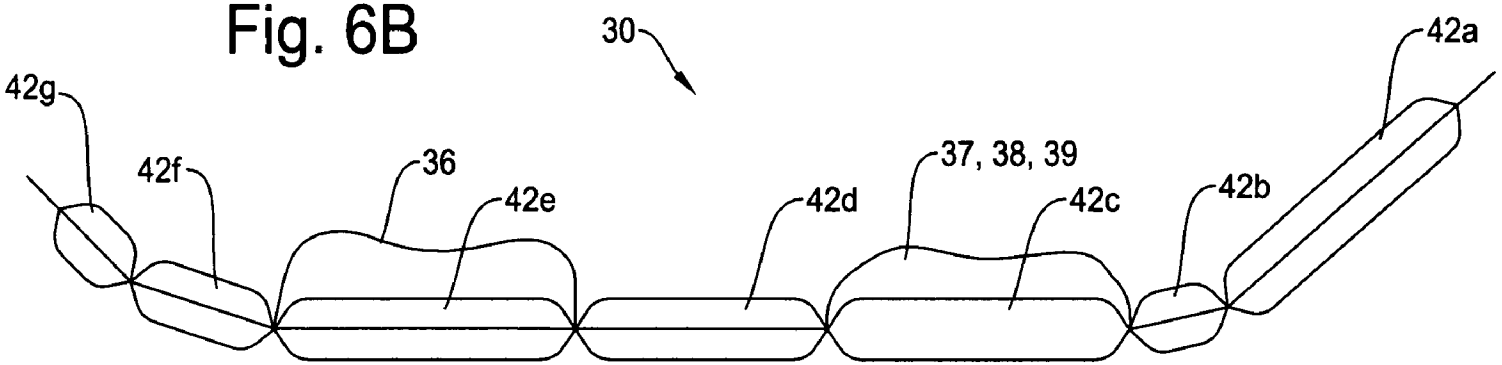

FIGS. 6A-8 show the process for folding the air-packing device of the present invention. FIGS. 6A and 6B are front views of the air-packing device of the present invention having a plurality of pockets 36-39 and inflated by the compressed air. The air-packing device 30 is laid flat in FIG. 6A and the air-packing device 30 is slighly folded in FIG. 6B. Although the product and its accessaries are inserted in the pockets before the air-packing device 30 is folded, such product and accessaries are not shown in FIGS. 6A and 6B for simplicity of illustration.

Figure 7B:
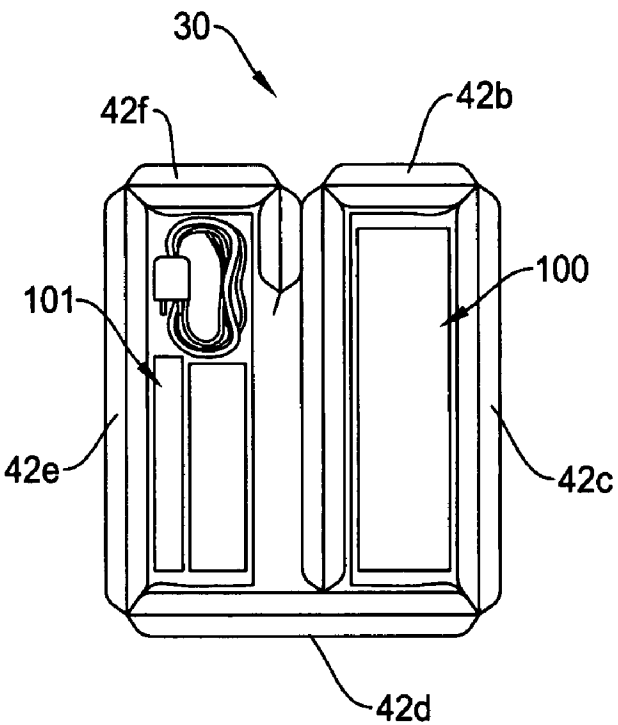
FIGS. 7A and 7B are front views showing an example of shape of the air-packing device of the present invention during the process of folding for packing an intended product in the pockets, where the air-packing device is further folded in FIG. 7A from the state of FIG. 6B, and the folding process is completed in FIG. 7B.
Figure 7A:
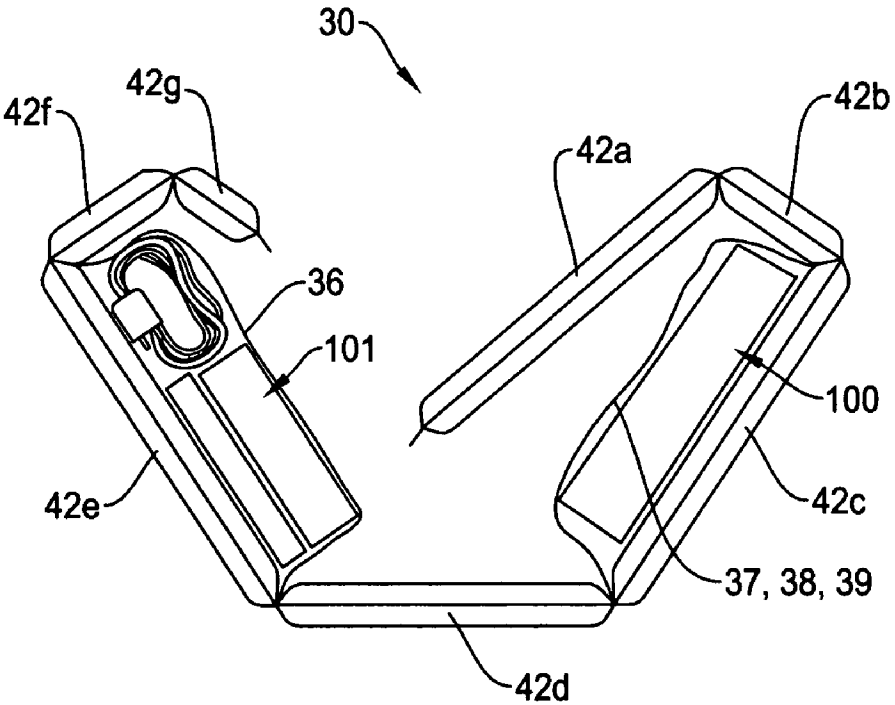

FIGS. 7A and 7B are front views showing an example of shape of the air-packing device of the present invention during the process of folding for packing an intended product and its accessaries in the pockets. The air-packing device 30 is further folded in FIG. 7A from the state of FIG. 6B, and the folding process is completed in FIG. 7B which matches the shape of a container box 75. FIGS. 7A and 7B show a product 100 and its accessories 101 in the corresponding pockets 36-39.

Figure 8:
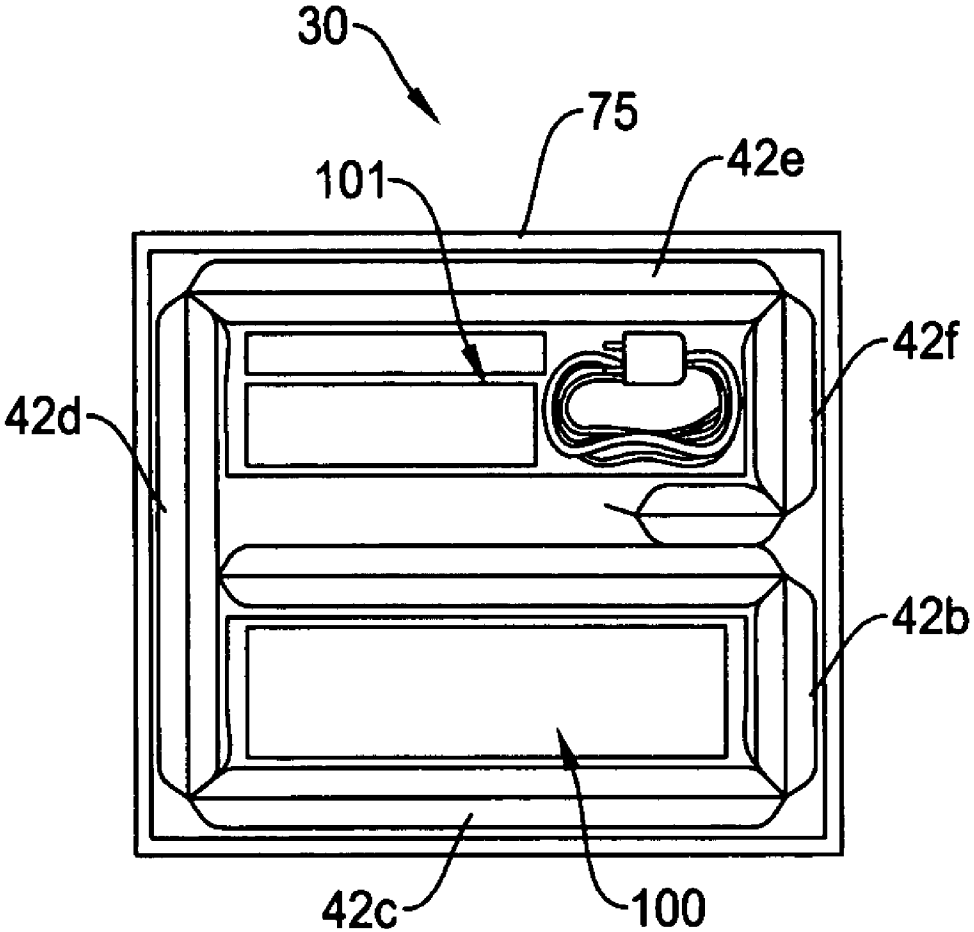
FIG. 8 is a cross sectional view showing the air-packing device of the present invention having the products in the pockets where the air-packing device is folded and installed in a container box after the process of FIG. 7B.

FIG. 8 is a cross sectional view showing the air-packing device of the present invention having the products in the pockets where the air-packing device is folded and installed in a container box 75 after the process of FIG. 7B. The container box 75 is made of hard paper, corrugated fiber board, etc., commonly used in the industry. Thus, the product 100 and its accessaries 101 are securely held in the corresponding pockets 36-39 and further tightly packed by the air-packing device 30 when installed in the container box. In the foregoing explanation with reference to FIGS. 6A-6B, 7A-7*b* and 8, the air-packing device 30 is filled with the compressed air before being folded, however, it is also possible that the air-packing device 30 is filled with the compressed air after being folded.

Figure 9:
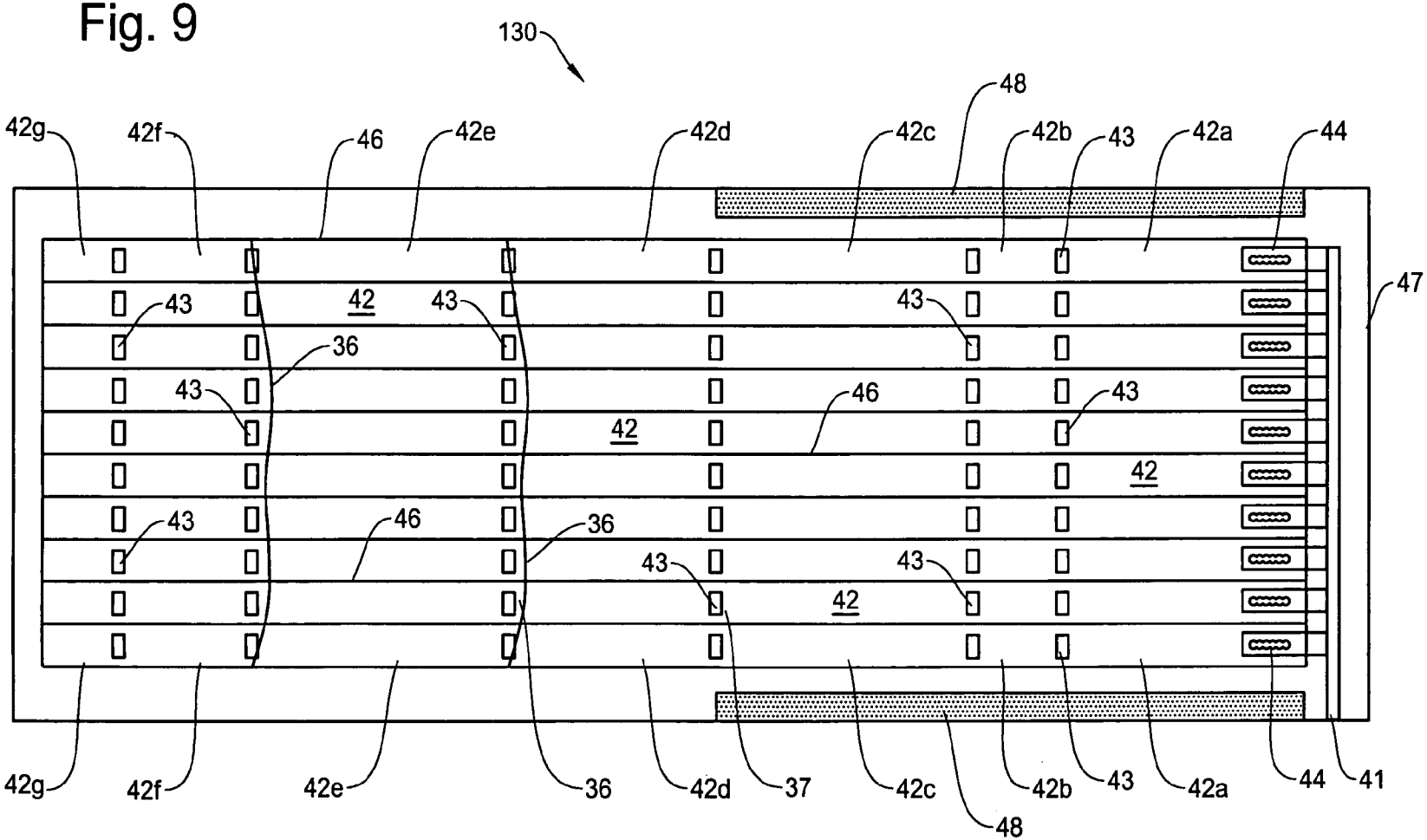
FIG. 9 is a plan view showing an example of sheet like construction of the second embodiment of the air-packing device of the present invention before being inflated by the compressed air.
Figure 10A:
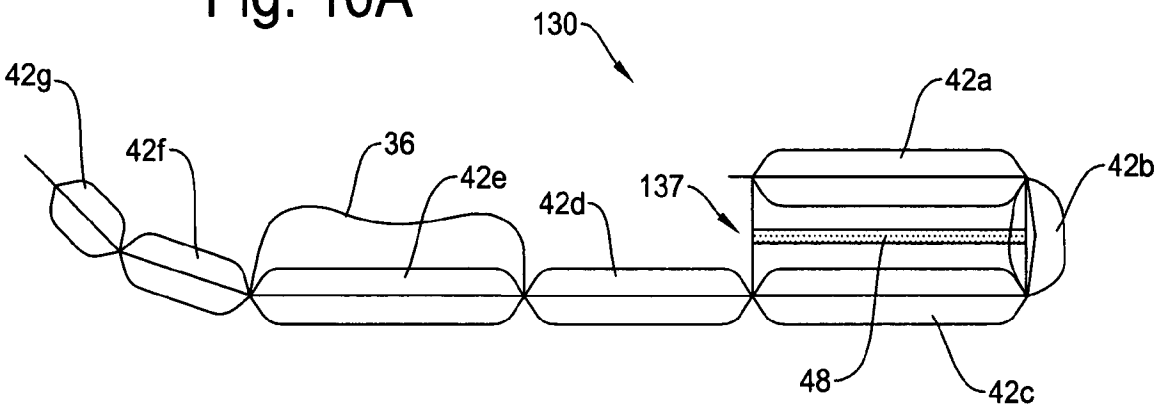
FIGS. 10A and 10B are front views showing an example of shape of the second embodiment of the air-packing device of the present invention of FIG. 9 during the folding process for packing an intended product in the pockets, where the air-packing device is folded in FIG. 10A, and the folding process is completed in FIG. 10B.
Figure 10B:
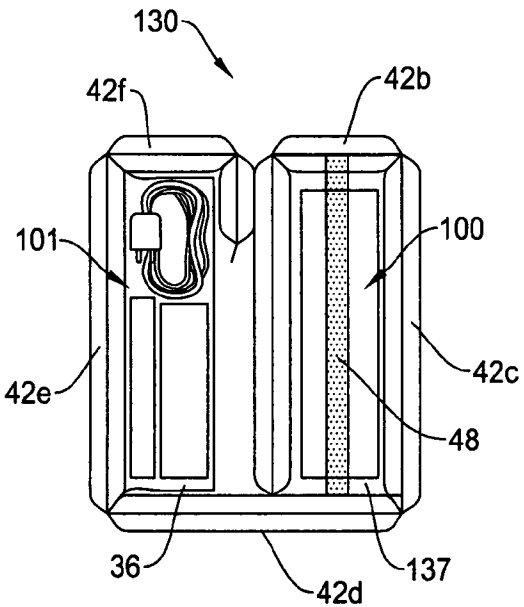

FIG. 9 is a plan view showing an example of sheet like construction of the second embodiment of the air-packing device of the present invention before being inflated by the compressed air. FIGS. 10A and 10B are front views showing an example of shape of the second embodiment of the air-packing device of the present invention of FIG. 9 during the folding process for packing an intended product in the pockets. Rhe air-packing device is folded in FIG. 10A, and the folding process for the air-packing device is completed in FIG. 10B.

In the second embodiment of the present invention, unlike the sheet like construction of FIG. 4, the air-packing device 130 of the present invention does not have the pockets 37-39 of FIG. 4. However, on the right half thereof, the air-packing device 130 has heat-seal areas 48 at the upper and lower sides for bonding to one another in a post heat-seal process. Namely, the right half of the air-packing device 130 is folded so that the right end thereof having the check valves 44 comes to a center thereof. In other words, the air-packing device 130 is folded in such a way that a longitudinal end thereof comes to an intermediate portion of the air-packing device 130. Then, the overlapped heat-seal areas 48 are bonded together both the upper and lower sides in the post heat-seal process. Such a process for folding and heat-sealing the air-packing device is performed before inflating the air-packing device 130.

Consequently, when inflated by the compressed air as shown in FIG. 10A, the air-packing device 130 establishes a pocket portion 137 which is formed with the air cells 42*a*-42*c* and the heat-seal areas 48. The product 100 and/or its accessaries are inserted in the pocket portion 137 created in the manner noted above and the air-packing device 130 is folded in a manner similar to the process of FIGS. 6A-6*b* and 7A-7B. Thus, the folding process is completed in FIG. 10B to a shape which matches the shape of a container box 75. In this example, the product 100 is installed in the pocket portion 137 formed of the air cells 42*a*-42*c* and heat-seal areas 48, and the accessories 101 are packed in the pocket 36 formed of the sheet of thermoplastic film.

Because the air-packing device of the present invention has one or more pockets as described above, a relatively small product and its accessaries are stored in the corresponding pockets. Then, the air-packing device filled with the compressed air is folded to securely pack the product and the accessaries therein. Thus, the product and its accessaries are securely held in the corresponding pockets and further tightly packed by the air-packing device when installed in the container box, thereby protecting the product and accessaries from the shock and impact.

Figure 11A:
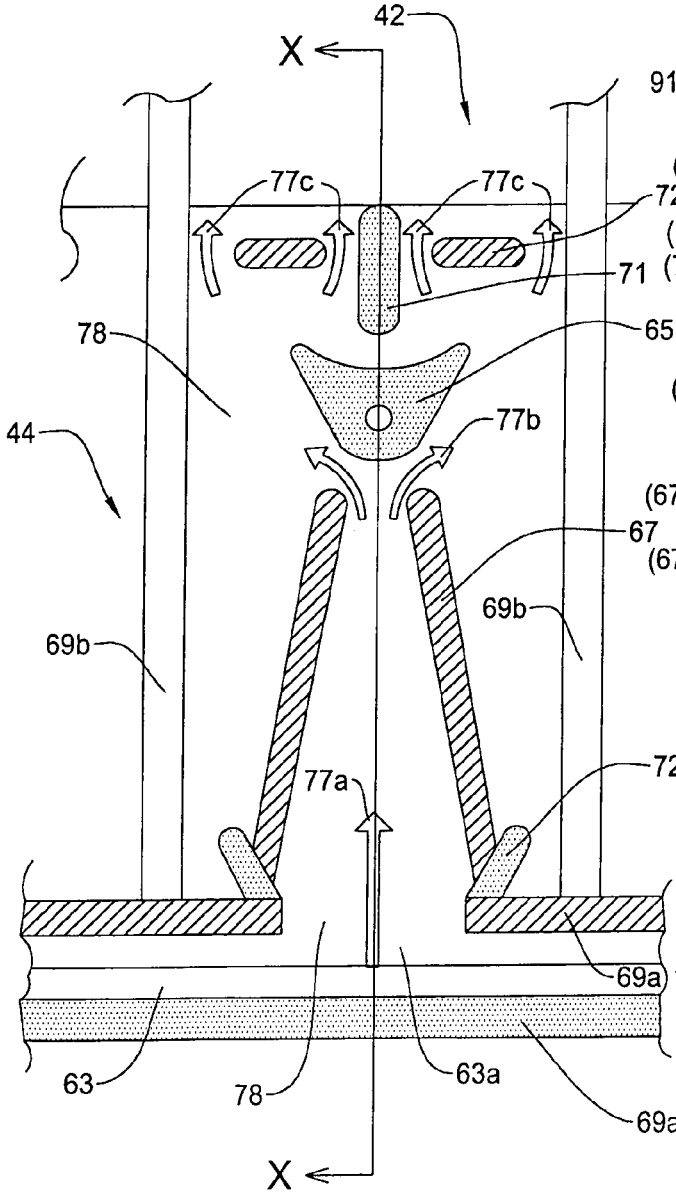
FIGS. 11A-11C are diagrams showing an example of detailed structure and operation of the check-valve in the present invention where
Figure 11B:
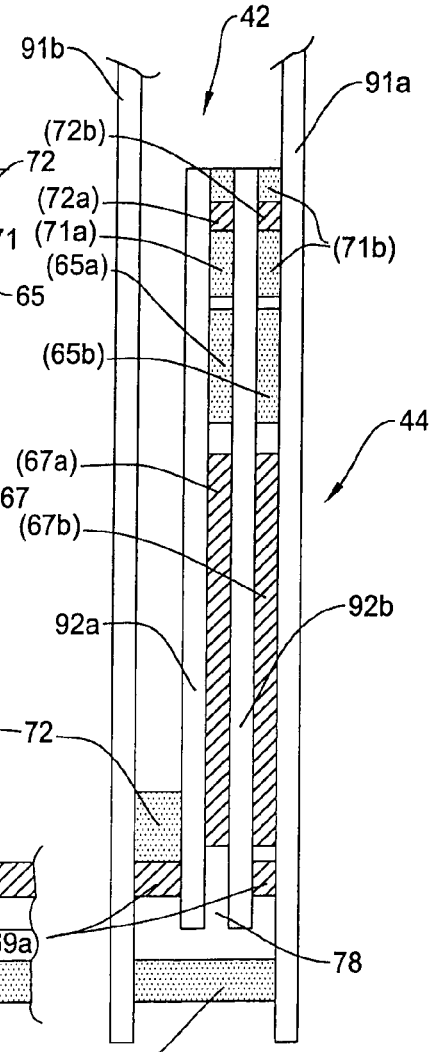
Figure 11C:
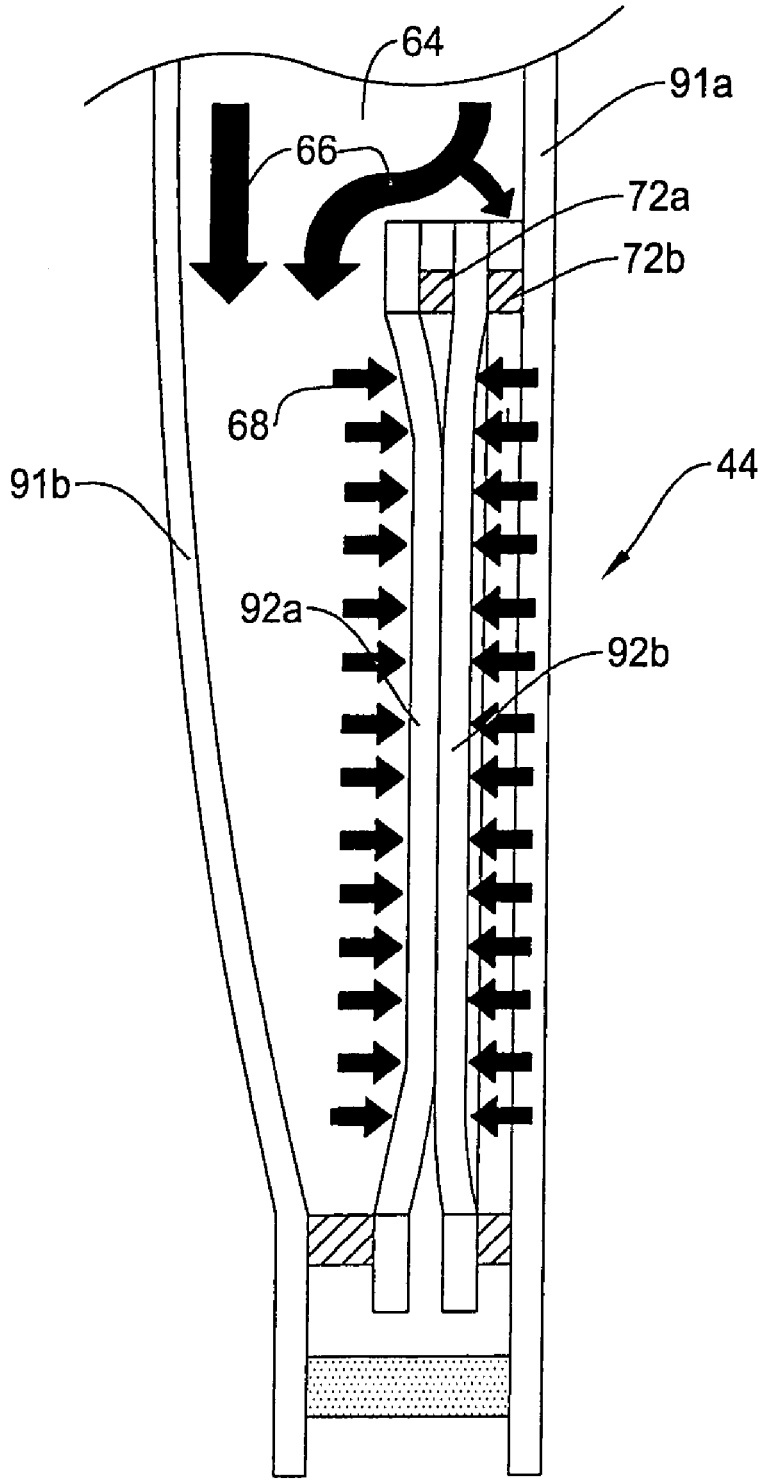

FIGS. 11A-11C show, in more detail, an example of structure of a check valve that are implemented in the present invention. FIG. 11A is a top view of the check valve 44, FIG. 11B is a cross sectional side view of the check valve 44 taken along the line X-X in FIG. 11A when the compressed air is not supplied to the air-packing device, and FIG. 11C is a cross sectional side view of the check valve 44 when the compressed air is supplied to the air-packing device.

In the example of FIGS. 11A and 11B, reinforcing seal portions 72 are formed near a check valve inlet 63*a*. These portions are placed in a manner of contacting each edge of the inlet portion 63*a*. The seal portions 72 are provided to reinforce a boundary between the guide passage 63 and the air container 42 (air cells 42*a*-42*g*) so as to prevent the air container from a rupture when it is inflated. In the check valve 44 of the present invention, the reinforcing seal portions 72 are preferable but not essential and thus can be omitted.

In the air-packing device 130, the two check valve films 92*a* and 92*b* are juxtaposed (superposed) and sandwiched between the two air-packing films 91*a* and 91*b* near the guide passage 63, and fixing seal portions 71-72, 65 and 67. The fixing seal portions 71-72 are referred to as outlet portions, the fixing seal portion 65 is referred to as an extended (or widened) portion, and the fixing seal portion 67 is referred to as a narrow down portion. These fixing seal portions also form the structure of the check valve 44 and fix the valve to the first air-packing film 91*a* at the same time. The fixing seal portions 65 are made by fusing the check valve films 92*a* and 92*b* only with the first air-packing film 91*a*.

The check valve 44 is made of the two check valve films (thermoplastic films) 92*a*-92*b* by which an air pipe (passage) 78 is created therebetween. How the air passes through the check valve 44 is shown by arrows denoted by the reference numbers 77*a*, 77*b* and 77*c* in FIG. 11A. The compressed air is supplied from the guide passage 63 through the air pipe 78 to the air container 42 (air cells 42*a*-42*g*).

In the check valve 44, the regular air relatively easily flows through the air pipe 78 although there exist the fixing seal portions 65, 67 and 71-72. However, the reverse flow of the air in the valve will not pass through the air pipe 78. In other words, if the reverse flow occurs in the air pipe 78, it is prevented because of a pressure of the reverse flow itself. By this pressure, the two surfaces of check valve films 92*a* and 92*b* which face each other, are brought into tight contact as shown in FIG. 11C as will be explained later.

As has been described, in FIGS. 11A-11B, the fixing seal portions 65, 67 and 71-72 also work for guiding the air to flow in the check valve 44. The fixing seal portions are comprised of the portions 71*a*, 72*a*, 65*a* and 67*a* which bond the two check-valve films 92*a* and 92*b* together, and the portions 71*b*, 72*b*, 65*b* and 67*b* which bond the first air-packing film 91*a* and the first check valve film 92*b* together. Accordingly, the air pipe 78 in the check valve 44 is created as a passage formed between the two check valve films 92*a*-92*b*.

Further in FIG. 11A, the fixing seal portions 67 are composed of two symmetric line segments extended in an upward direction of the drawing, and a width of the air pipe 78 is narrowed down by the fixing seal portions (narrow down portions) 67. In other words, the regular flow can easily pass through the air pipe 78 to the air cell 42 when passing through the wide space to the narrow space created by the narrow down portions 67. On the other hand, the narrow down portions 67 tend to interfere the reverse flow from the air cells 42 when the air goes back through the narrow space created by the narrow down portions 67.

The extended portion 65 is formed next to the narrow down portions 67. The shape of the extended portion 65 is similar to a heart shape to make the air flow divert. By passing the air through the extended portion 65, the air diverts, and the air flows around the edge of the extended portion 65 (indicated by the arrow 77*b*). When the air flows toward the air cells 42 (forward flow), the air flows naturally in the extended portion 65. On the other hand, the reverse flow cannot directly flow through the narrow down portions 67 because the reverse flow hits the extended portion 65 and is diverted its direction. Therefore, the extended portion 65 also functions to interfere the reverse flow of the air.

The outlet portions 71-72 are formed next to the extended portion 65. In this example, the outlet portion 71 is formed at the upper center of the check valve 44 in the flow direction of the air, and the two outlet portions 72 extended to the direction perpendicular to the outlet portion 71 are formed symmetrically. There are several spaces among these outlet portions 71 and 72. These spaces constitute a part of the air pipe 78 through which the air can pass as indicated by the arrows 77*c*. The outlet portions 71-72 are formed as a final passing portion of the check valve 44 when the air is supplied to the air container 42 (air cells 42*a*-42*g*) and the air diverts in four ways by passing through the outlet portions 71-72.

As has been described, the flows of air from the guide passage 63 to the air cells 42 is relatively smoothly propagated through the check valve 44. Further, the narrow down portions 67, extended portions 65 and outlet portions 71-72 formed in the check valve 44 work to interfere the reverse flow of the air. Accordingly, the reverse flow from the air cells 42 cannot easily pass through the air pipe 78, which promotes the process of supplying the air in the air-packing device.

FIG. 11C is a cross sectional view showing an effect of the check valve 44 of the present invention. This example shows an inner condition of the check valve 44 when the reverse flow tries to occur in the air-packing device when it is sufficiently inflated. First, the air can hardly enter the air pipe 78 because the outlet portions 71 and 72 work against the air such that the reverse flow will not easily enter in the outlet portions. Instead, the air flows in a space between the second air-packing film 91*b* and the second check valve film 92*a* as indicated by the arrows 66, and the space is inflated as shown in FIG. 11C. By this expansion, in FIG. 11C, the second check valve film 92*a* is pressed to the right, and at the same time, the first check valve film 92*b* is pressed to the left. As a result, the two check valve films 92*a* and 92*b* are brought into tight contact as indicated with the arrows 68. Thus, the reverse flow is completely prevented.

Figure 12A:
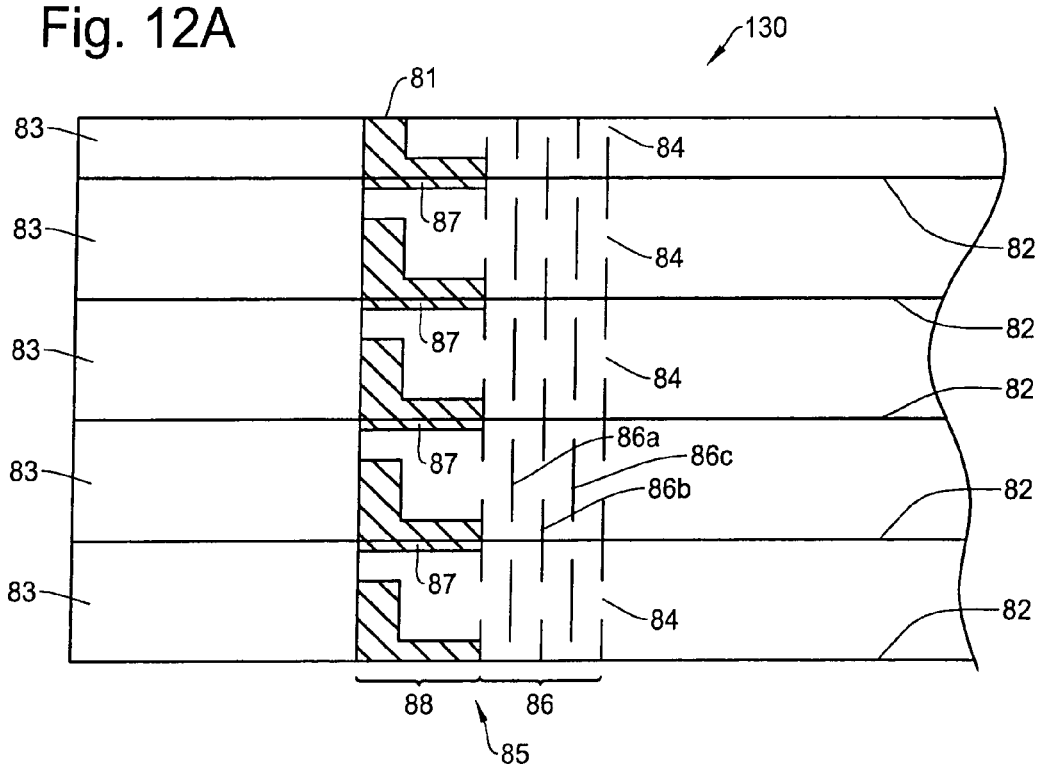
FIGS. 12A-12D show another example of check valve of the present invention where

Another example of the check valve of the present invention is described in detail with reference to FIGS. 12A-12D, 13-14 and 15A-15B in which a check valve is denoted by a reference numeral 85. FIGS. 12A-12D are plan views of the check valve used in the air-packing devices 130 of the present invention. FIG. 12A shows a structure of a check valve 85 and a portion of the air-packing device 130. The air-packing device 130 having the check valves 85 is comprised of two or more rows of air container each having serially connected air cells 83 which are equivalent to the air cells 42 in FIGS. 3-10. As noted above, typically, each row of air container has a plurality of series connected air cells 83 although only one air cell is illustrated in FIG. 12A.

Before supplying the air, the air-packing device 130 is in a form of an elongated rectangular sheet made of a first (upper) thermoplastic film 93 and a second (lower) thermoplastic film 94. To create such a structure, each set of series air cells are formed by bonding the first thermoplastic film (air packing film) 93 and the second thermoplastic film (air packing film) 94 by the separation seal (bonding area) 82. Consequently, the air cells 83 are created so that each set of series connected air cells can be independently filled with the air.

Figure 12B:
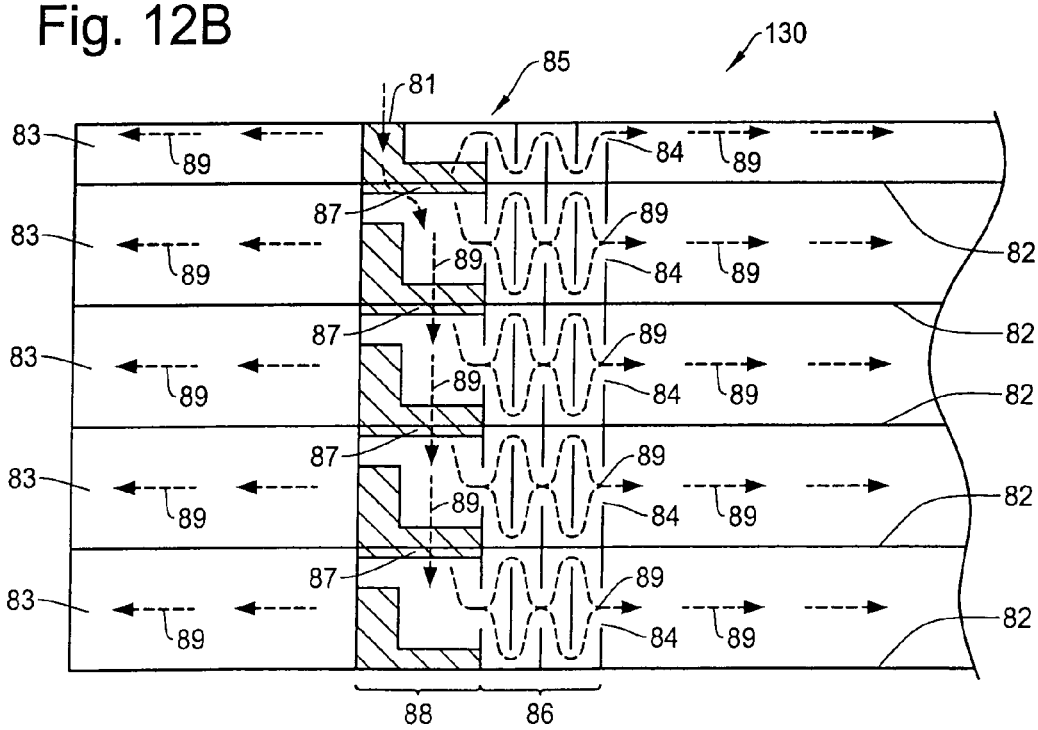
Figure 12C:
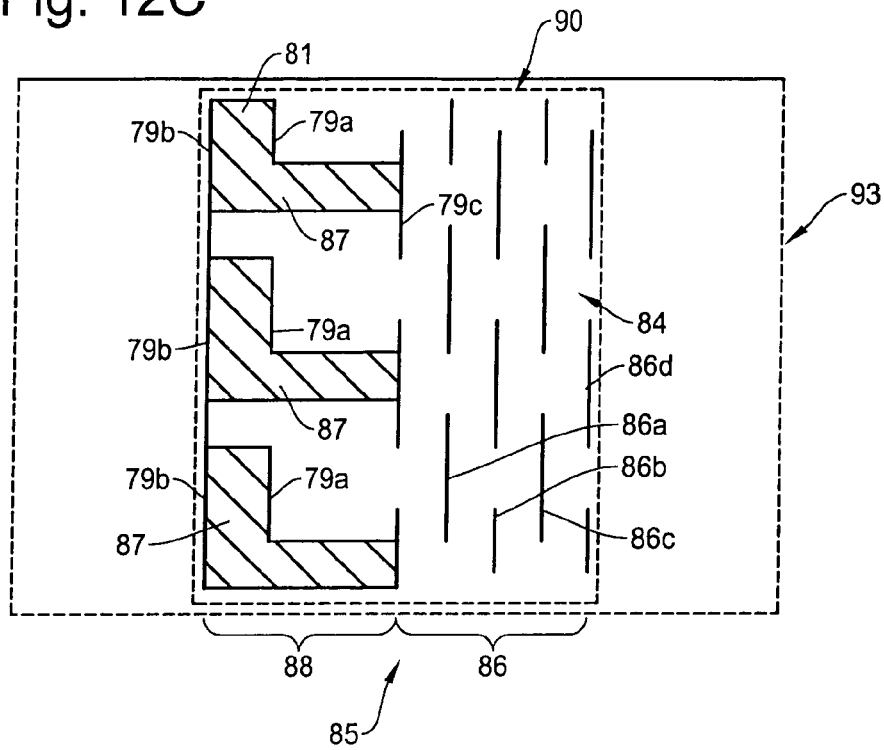

A check valve film 90 having a plurality of check valves 85 is attached to one of the thermoplastic films 93 and 94 as shown in FIG. 12C. When attaching the check valve film 90, peeling agents 87 are applied to the predetermined locations on the separation seals 82 between the check valve film 90 and one of the thermoplastic films 93 and 94. The peeling agent 87 is a type of paint having high thermal resistance so that it prohibits the thermal bonding between the first and second thermoplastic films 93 and 94. Accordingly, even when the heat is applied to bond the first and second thermoplastic films 93 and 94 along the separation seal 82, the first and second thermoplastic films 93 and 94 will not adhere with each other at the location of the peeling agent 87.

The peeling agent 87 also allows the air input 81 to open easily when filling the air in the air-packing device 130. When the upper and lower films 93 and 94 made of identical material are layered together, there is a tendency that both films stick to one another. The peeling agent 87 printed on the thermoplastic films prevents such sticking. Thus, it facilitates easy insertion of an air nozzle of the air compressor into the air inlet 81 when inflating the air-packing device.

The check valve 85 of the present invention is configured by a common air duct portion 88 and an air flow maze portion 86. The air duct portion 88 acts as a duct to allow the flows of the air from the air port 81 to each set of air cells 83. The air flow maze portion 86 prevents free flow of air between the air-packing device 130 and the outside, i.e., it works as a brake against the air flows, which makes the air supply operation easy. To achieve this brake function, the air flow maze portion 86 is configured by two or more walls (heat-seals) 86*a*-86*c*. Because of this structure, the air from the common air duct portion 88 will not straightly or freely flow into the air cells 83 but have to flow in a zigzag manner. At the and of the air flow maze portion 86, an exit 84 is formed.

In the air-packing device 130 incorporating the check valve 85 of the present invention, the compressed air supplied to the air input 81 to inflate the air cells 83 flows in a manner as illustrated in FIG. 12B. The plan view shown in FIG. 12B includes the structure of the check valve 85 identical to that of FIG. 12A and further includes dotted arrows 89 showing the flows of the air in the check valve 85 and the air cells 83. As indicated by the arrows 89, the air from the check valve 85 flows both forward direction and backward direction of the air-packing device 130. Thus, the check valve 85 can be formed at any locations of the air-packing device 130. Further, the check valve 85 requires a relatively low pressure of the air compressor when it is attached to an intermediate location of the air-packing device 130.

In FIG. 12B, when the air is supplied to the air input 81 from the air compressor (not shown), the air flows toward the exit 84 via air duct portion 88 and the air flow maze portion 86 as well as toward the next adjacent air cell 83 via the air duct portion 88. The air exited from the exit 84 inflates the air cell 83 by flowing both forward and backward directions (right and left directions of FIG. 12B) of the air-packing device 130. The air transferred to the next air cell flows in the same manner, i.e., toward the exit 84 and toward the next adjacent air cell 83. Such operations continue from the first air cell 83 to the last air cell 83. In other words, the air duct portion 88 allows the air to flow to either the present air cell 83 through the air flow maze portion 86 and to the next air cell 83.

Figure 12D:
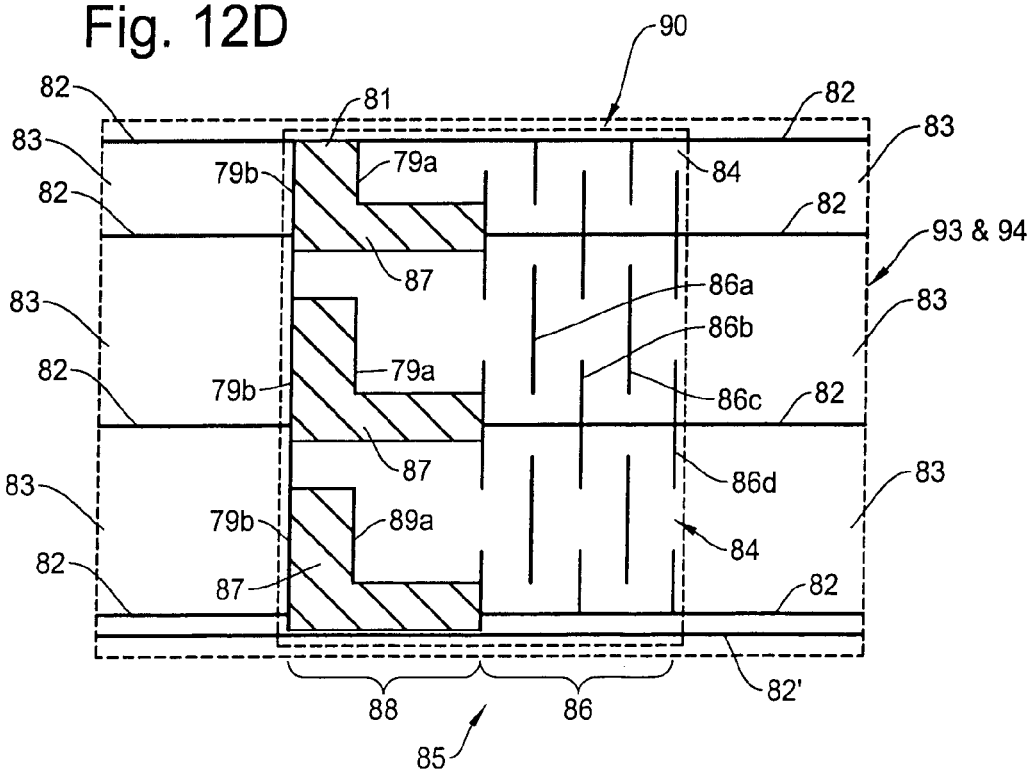

FIGS. 12C-12D show an enlarged view of the check valve of the present invention for explaining how the check valves 85 are created on the air-packing device. As noted above, the check valve film 90 is attached to either one of the thermoplastic film 93 or 94. The example of FIGS. 12C and 12D show the case where the check valve film 90 is attached to the upper (first) thermoplastic film 93. The thick lines in the drawings indicate the heat-seal (bonding) between the thermoplastic films.

The air-packing device of the present invention is manufactured by bonding the second (lower) thermoplastic film 94, the check valve film 90, and the first (upper) thermoplastic film 93 by pressing the films with a heater. Since each film is made of thermoplastic material, they will bond (welded) together when the heat is applied. In this example, the check valve film 90 is attached to the upper thermoplastic film 93, and then, the check valve film 90 and the upper thermoplastic film 93 are bonded to the lower thermoplastic film 94.

First, as shown in FIG. 12C, the check valve film 90 is attached to the upper thermoplastic film 93 by heat-sealing the two films at the portions indicated by the thick lines. Through this process, the peeling agents 87 applied in advance to the check valve film 90 is attached to the upper thermoplastic film 93 by the bonding lines 79*a* and 79*b* to create the air duct portions 88. Further, the air flow maze portions 86 are created by the bonding lines 86*a*-86*c*, etc. At the end of the maze portion 86 is opened to establish the air exit 84.

Then, as shown in FIG. 12D, the check valve film 90 and the upper thermoplastic film 93 are attached to the lower thermoplastic film 94 by heat-sealing the upper and lower films at the portions indicated by the thick lines 82. Through this process, each air cell 83 is separated from one another because the boundary between the two air cells is closed by the sealing line (boundary line) 82. However, the range of the sealing line 82 having the peeling agent 87 is not closed because the peeling agent prohibits the heat-sealing between the films. As a result, the air duct portion 88 is created which allows the air to flow in the manner shown in FIG. 12B.

Figure 13:
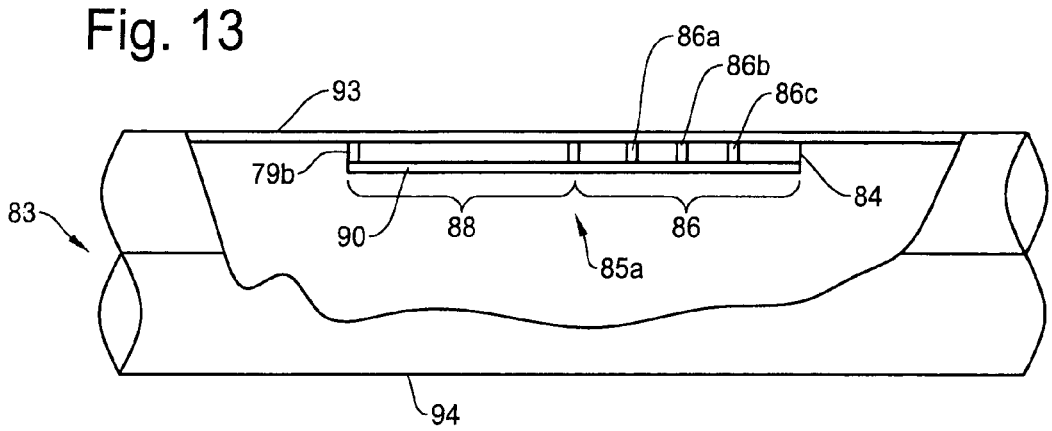
FIG. 13 is a cross sectional view showing an example of inner structure of the check valve in the present invention configured by a single layer film and formed on one of the thermoplastic films of the air-packing device.

FIG. 13 is a partial cross sectional front view showing an example of inner structure of the check valve 85*a* of the present invention configured by a single layer film and formed on a thermoplastic film of the air-packing device. As described in the foregoing, the common air duct portion 88 and the air flow maze portion 86 are created between the check valve film 90 and one of the upper and lower thermoplastic films 93 and 94. In this example, the check valve film 90 is attached to the upper thermoplastic film 93 through the heat-sealing in the manner described with reference to FIG. 12C.

The air flow maze portion 86 has a maze structure such as a zig-zaged air passage to cause resistance to the air flow such as reverse flow. Such a zig-zaged air passage is created by the bonding (heat-sealed) lines 86*a*-86*c*. Unlike the straight forward air passage, the maze portion 86 achieves an easy operation for inflating the air-packing device by the compressed air. Various ways for producing the resistance of the air flow are possible, and the structure of the maze portion 86 shown in FIGS. 12A-12D and 13 is merely one example. In general, the more complex the maze structure, the less area of the maze portion 86 is necessary to adequately produce the resistance against the air flow.

Figure 14:
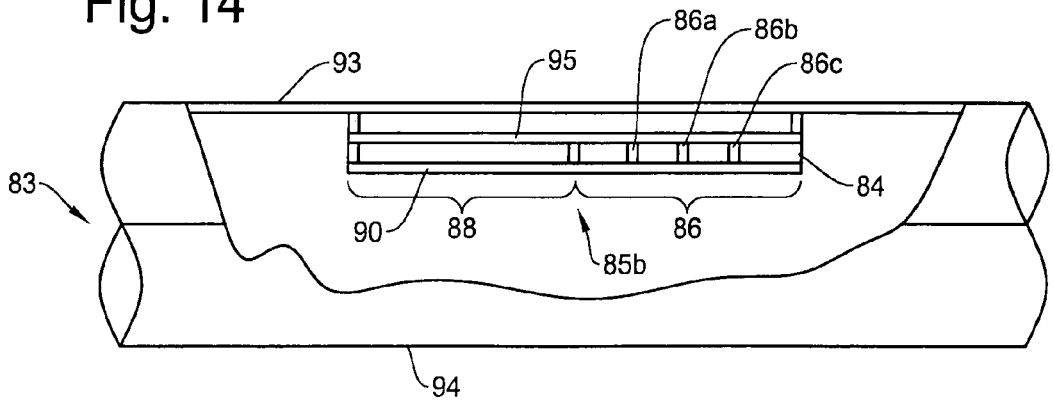
FIG. 14 is a cross sectional view showing another example of the inner structure of the check valve in the present invention configured by double layer films and formed on one of the thermoplastic films of the air-packing device.

FIG. 14 is a cross sectional view showing another example of the inner structure of the check valve 85*b* in the present invention configured by double layer films and formed on one of the thermoplastic films of the air-packing device. In this example, an addition film 95 is provided between the upper thermoplastic film 93 and the check valve film 90. The additional film 95 and the check valve film 90 forms the check valves 85*b*. The additional film 95 is so attached to the upper thermoplastic film 93 that the space between the upper thermoplastic film 93 and the additional film 95 will not transmit air.

The advantage of this structure is the improved reliability in preventing the reverse flows of air. Namely, in the check valve of FIG. 13, when the air is filled in the air cell 83, the upper thermoplastic film 93 of the air cell having the check valve 85 is curved. Further, when a product is loaded in the air-packing device, the surface projection of the product may contact and deform the outer surface of the air cell having the check valve therein. The sealing effect created by the check valve can be weakened because of the curvature of the air cell. The additional film 95 in FIG. 14 mitigates this problem since the film 95 is independent from the upper thermoplastic film 93.

Figure 15A:
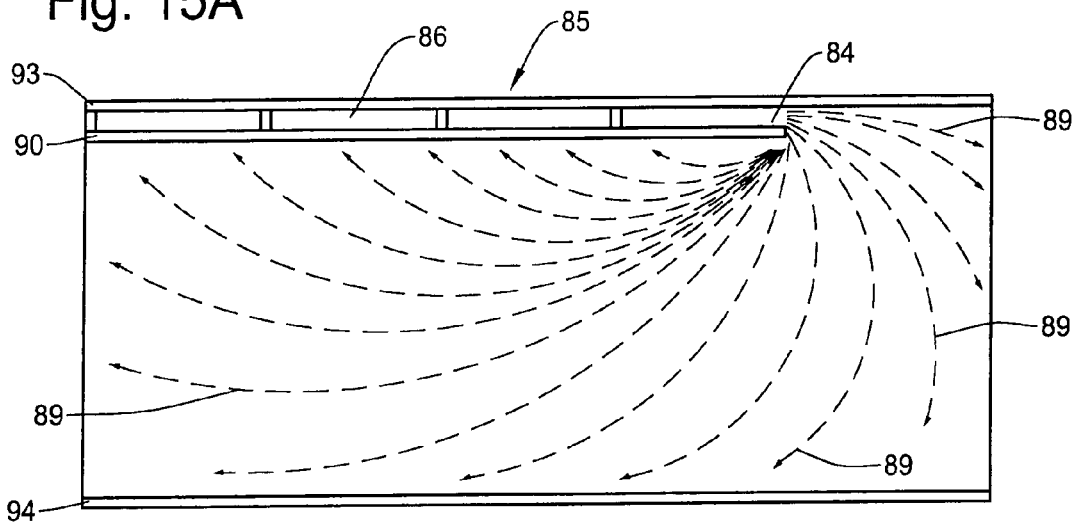
FIGS. 15A and 15B are cross sectional views showing the inner structure of a check valve of the present invention where
Figure 15B:
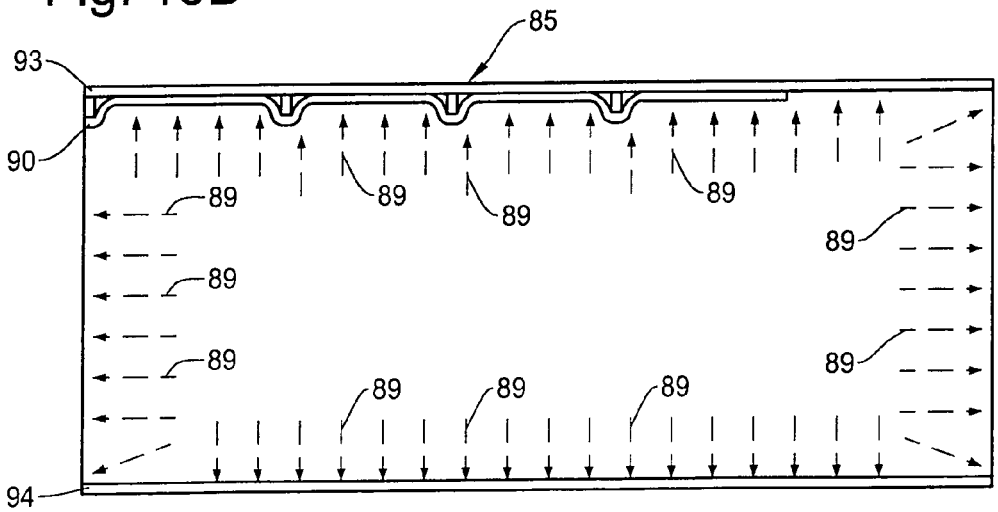

FIG. 15A and 15B are cross section views showing the inside of the air cell having the check valve 85. FIG. 15A shows the condition wherein the compressed air is being introduced into the air-packing device through the check valve 85. FIG. 15B shows the condition where the air-packing device is filled with air to an appropriate degree so that the check valve 85 is operated to effectively close by the inside air pressure. The dotted arrows 89 indicate the flow of air in FIGS. 15A and 15B.

As shown in FIG. 15A, when the air is pumped in from the air input 81 (FIGS. 12A-12B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 86 and exits from the exit 84 at the end of the maze portion 86. All of the air cells will eventually be filled with the compressed air.

As shown in FIG. 15B, when the air cell having the check valve 85 is inflated to a certain extent, the inner pressure of the air will push the check valve film 90 upward so that it touches the upper thermoplastic film 93. FIG. 15B mainly shows the air flow maze portion 86 of the check valve 85 to show how the check valve 85 works. When the inner pressure reaches a sufficient level, the check valve film 90 air-tightly touches the upper thermoplastic film 93, i.e., the check valve 85 is closed, thereby preventing the reverse flows of the air.

As has been described above, according to the present invention, the air-packing device can minimize the shocks or vibrations to the product when the product is dropped or collided. The air-packing device is comprised of multiple rows of air containers each having a plurality of air cells connected in series. One or more pockets are formed by using additional thermoplastic films to receive a product and its accessaries therein. After being inflated by the compressed air, the air-packing device is folded, thereby creating a unique structure and stored in container box.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An air-packing device inflatable by compressed air for protecting a product therein, comprising:

first and second thermoplastic films superposed with each other where predetermined portions of the first and second the thermoplastic films are bonded, thereby creating a plurality of air containers;

a plurality of heat-seal lands each sealing the first and second thermoplastic films in a small area of the air container in a manner, thereby creating a plurality of series connected air cells for each air container and allowing air flow between the air cells;

a plurality of check valves for corresponding air containers established between the first and second thermoplastic films for allowing the compressed air to flow in a forward direction;

an air input commonly connected to the plurality of check valves to supply the compressed air to all of the air cells through the check valves;

at least one pocket formed by a sheet of thermoplastic film bonded to either the first thermoplastic film or the second thermoplastic film at boundaries of the air containers; and a pocket portion created by folding the air-packing device in such a way that a longitudinal end comes to an intermediate portion of the air packing device and heat-sealing the side edges thereof that are overlapped with one another.

2. An air-packing device as defined in claim 1, wherein the product is installed in the pocket and the air cells of the air-packing device are inwardly folded when packing the product therein.

3. An air-packing device as defined in claim 1, wherein the product is installed in the pocket and the air cells of the air-packing device are inwardly folded when packing the product therein, and wherein the air-packing device which packs the product therein is installed in a container box.

4. An air-packing device as defined in claim 1, wherein each end of the sheet forming each of the pockets is bonded to an area where the first and second thermoplastic films are bonded to one another where the sheet has a sufficient length so that a sufficient space is created over the air cells for receiving the product therein.

5. An air-packing device as defined in claim 1, wherein each of the heat-seal lands which heat-seal the first and second thermoplastic films is formed at about a center of the air container to define the air cells, the heat-seal lands are folding points when the air-packing device is inflated by the compressed air.

6. An air-packing device as defined in claim 5, wherein each of the heat-seal lands creates two air flow passages at both sides thereof in the air container thereby allowing the compressed air to flow to the series connected air cells through the two air passages.

7. An air-packing device as defined in claim 1, wherein the pocket portion is created before inflating the air-packing device by folding the air-packing device and heat-sealing the side edges thereof that are overlapped with one another.

8. An air-packing device as defined in claim 1, wherein the check valve includes sealed portions which are fixed to one of thermoplastic films configuring the air-packing device, wherein the sealed portions include:

an inlet portion which introduces the air into the check valve;

a pair of narrow down portions creating a narrow down passage connected to the inlet portion;

an extended portion which diverts the air flows coming through the narrow down passage; and a plurality of outlet portions which introduce the air from the extended portion to the air container.

9. An air-packing device as defined in claim 8, wherein reinforcing seal portions are formed close to the inlet portion to reinforce the bonding between the check valve and one of the first and second thermoplastic films.

10. An air-packing device as defined in claim 1, wherein the check valve is comprised of:

a check valve film on which peeling agents of predetermined pattern are printed, the check valve film being attached to one of first and second thermoplastic films configuring the air-packing device;

an air input established by one of the peeling agents on the air-packing device for receiving an air from an air source;

an air flow maze portion forming an air passage of a zig-zag shape, the air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for separating two adjacent air containers is prevented in a range where the peeling agent is printed.

11. An air-packing device as defined in claim 10, wherein the check valves are formed at any desired position on the air-packing device where the air from the check valve flows in both forward and backward directions in the air container to fill all of the series connected air cells therein.

12. An air-packing device as defined in claim 10, wherein an additional film is provided between the check valve film and one of the first and second thermoplastic films.

13. An air-packing device as defined in claim 10, wherein the check valve film is attached to one of the first and second thermoplastic films at any desired locations of the air-packing device.

14. An air-packing device as defined in claim 10, wherein at least the air passage in the air flow maze portion is closed by air tightly contacting the check valve film with one of the first and second thermoplastic films by the air pressure within the air cell when the air-packing device is filled with the compressed air to a sufficient degree.

15. An air-packing device as defined in claim 14, wherein at least the air passage in the air flow maze portion is closed by air tightly contacting the check valve film with the additional film by the air pressure within the air cell when the air-packing device is filled with the compressed air in a sufficient level.

* * * * *